US007849981B2

(12) United States Patent
De la Fuente-Farias

(10) Patent No.: US 7,849,981 B2
(45) Date of Patent: Dec. 14, 2010

(54) SPARE BRAKE BEAM HAVING REPLACEABLE BRAKE HEADS

(75) Inventor: Jorge De la Fuente-Farias, Nuevo Leon (MX)

(73) Assignee: Stucki De Mexico, De R.L. De C.V., Nuevo Leon (MX)

( * ) Notice: Subject to any disclaimer, the term of this patent is extended or adjusted under 35 U.S.C. 154(b) by 1078 days.

(21) Appl. No.: 11/399,496

(22) Filed: Apr. 7, 2006

(65) Prior Publication Data

US 2006/0219502 A1 Oct. 5, 2006

Related U.S. Application Data

(63) Continuation-in-part of application No. 11/098,523, filed on Apr. 5, 2005, now Pat. No. 7,410,037.

(51) Int. Cl.
*B61H 13/36* (2006.01)

(52) U.S. Cl. ..... 188/220.1; 188/225.6; 188/229.1; 188/231

(58) Field of Classification Search ..... 188/219.6, 188/220.1, 220.6, 221.1, 225.6, 226.1, 228.6, 188/229.1, 231, 232; 411/10, 11
See application file for complete search history.

(56) References Cited

U.S. PATENT DOCUMENTS

| | | | | | |
|---|---|---|---|---|---|
| 1,809,745 | A * | 6/1931 | Davis | ..... | 188/219.6 |
| 2,507,062 | A * | 5/1950 | Tack | ..... | 188/221.1 |
| 2,516,696 | A * | 7/1950 | Gothberg | ..... | 188/221.1 |
| 2,885,036 | A * | 5/1959 | Walker | ..... | 188/229.1 |
| 2,946,410 | A * | 7/1960 | Spaeth | ..... | 188/219.6 |
| 5,913,647 | A * | 6/1999 | Hodge | ..... | 411/11 |
| 6,234,283 | B1 * | 5/2001 | Montes-Ramos | ..... | 188/226.1 |
| 6,551,003 | B1 * | 4/2003 | De La Fuente-Farias | . | 188/219.1 |
| 7,410,037 | B2 * | 8/2008 | De La Fuente-Farias | . | 188/219.1 |

* cited by examiner

*Primary Examiner*—Thomas J Williams
(74) *Attorney, Agent, or Firm*—Young & Thompson

(57) ABSTRACT

A brake beam including means for allowing the brake head to be replaced without effort and to include replaceable brake heads.

6 Claims, 9 Drawing Sheets

SPARE BRAKE BEAM HAVING REPLACEABLE BRAKE HEADS

BACKGROUND OF THE INVENTION

A. Field of the Invention

The present invention is related to brake beams for railway cars, and more particularly to a brake beam which allows a quick installation thereof and a quick replacement of its brake head if required.

B. Description of the Related Art

There are well known brake heads assemblies for railway cars by which a brake shoe is pressed against a wheel in order to decrease or stop the rotational speed of the wheel and railway car.

Generally, the brake head assembly is held by a structure called "brake beam" mounted transversely in the bogie of a railway car and is linked to a lever, which applies a force in order to press the brake shoe against a wheel.

The brake beam generally comprises, a generally "V" shaped tension member a compression member having its ends coupled to the ends of the tension member, a brake head subassembly linked to the each end of the compression member, two end extensions each coupled to an end of the compression member by which the brake beam is coupled to the bogie of a railway car and a fulcrum coupled to the compression member and tension member, so that the fulcrum remains between the tension and compression members. The end extensions of the brake beam are coupled to both pocket guides of the trucks The main reasons for replacing a Brake Beam out of a freight car are the following:

A worn out condition.

A broken brake beam

A bent brake beam

A missing brake beam

When it is necessary to install a new brake beam, the damaged car must be decupled from the train, and taken to a repairing facility which could be many miles away.

Once in the facility, the car must be jacked up, then the truck must be disconnected and retired from under the car, proceeding to the dismantling of side frames and corresponding wheel set, in order to decuple the brake beam end extensions from the pocket guides and then remove the damaged brake beam, for reapplication of the new brake beam, proceeding then to reinsert wheel set and side frames, push truck under the car, reconnect and lower the car body on top.

The above referred operation is a main cause for car repair personnel injuries, it's very complex, it's costly and time consuming since it may take from 3 to 7 days to replace a brake beam. And worst, the owner of the car and the transport company, looses money for each minute the car is inactive, besides angry customers since usually the car that is cut from the train is completely loaded, facing penalties or damaged perishable goods.

Furthermore, normally, the brake heads are fixedly or pivotally linked to the brake beam by means of bolts passing through perforations located at the ends of the brake beam and through perforations located at the brake heads. Also, the brake heads may be linked to a brake beam by welding the brake head directly to the ends of the brake beam, or are integral to the beam ends as is the case of the cast beams.

When it is necessary to replace a brake head welded to the brake beam, normally the whole brake beam is replaced since it is extremely difficult to detach a welded brake head from the brake beam.

For brake beams having brake heads linked by bolts, when it is necessary to replace a brake head due to a worn out condition, it is very difficult to just decouple the damaged brake head since the bolts are usually not designed to be retired from the brake beam. Furthermore, since the bolts that join the brake head to the brake beam normally link the tension member, compression member and brake head together, if said bolts are retired the whole brake beam would become disassembled.

In view of the above referred problems, it is better opted to have the whole brake beam replaced. The process for replacing a brake beam begins with decoupling the car having the damaged brake head from the train, and taking it to a repairing facility which could be many miles away.

In order to reduce the time and effort necessary to replace a brake beam, or a brake head only, applicant developed a brake beam including means for avoiding the dismantling thereof, which can be quickly and easily installed in a train car without the necessity of cutting the car from the train nor dismantling the car nor the truck and/or which its brake head can be quickly and easily installed in a train car without the necessity of replacing the whole brake beam and consequently without cutting the car from the train nor dismantling the car nor the truck.

Thanks to applicant's brake beam it is not necessary to dismantle the car for replacing the brake beam and therefore the operation can be carried out without cutting the car from the train thus saving money on labor and materials.

Furthermore, the brake beam replacement operation can be completed in matter of minutes, saving time on all type of freight cars using a standard Brake beam, being particularly beneficial on intermodal or premium service trains and avoiding penalties and costs related with previous mounting systems.

Thanks to the brake beam of the present invention, it is possible to replace any kind of brake beam which is found at a damaged condemnable condition under a car in service, by a simple torch cut off process of the damaged beam under the car, pulling then the damaged component from the car bottom, which activity is simple and familiar to must skilled in the car repair art, and be then able to install the brake beam of the present invention, as an spare brake beam, right there and then, without the dismantling of the train, car nor truck, with simple common tools and skills.

Since it is no longer necessary to dismantle the car for changing a brake beam, there are avoided the related and common accidents and personal injuries to the maintenance staff.

Last but not least (when) the brake beam of the present invention is adapted to receive a replaceable brake head, it is possible, when installed in the car, to replace the brake head which is found at a damaged condemnable condition under a car in service, by a simple torch cut off process of the bolt holding the damaged brake head of the beam under the car, pulling then the damaged component from the car bottom, which activity is simple and familiar to must skilled in the car repair art, and be then able to install the replaceable brake head of the present invention, as an spare brake head, right there and then, without the dismantling of the train, car nor truck, with simple common tools and skills.

Finally, thanks to the DTI included in the replaceable brake head and or on one end of the coupling section of the spare beam, when it is necessary to replace the brake head, the bolt that joins the brake head to the brake beam can be adjusted at the correct tension without the need of checking it with a feeler gauge or to loosing and tightening the bolt repeatedly until the correct tension is achieved.

SUMMARY OF THE INVENTION

It is therefore a main object of the present invention to provide a brake beam including means for avoiding the dismantling of the same which can be quickly and easily installed in the boogie of a train car, and whose brake head can be quickly and easily replaced in a train car without the necessity of replacing the whole brake beam and consequently without cutting the car from the train nor dismantling the car nor the truck.

It is another main object of the present invention to provide a brake beam which can be installed without dismantling the car and therefore the operation can be carried out without cutting the car from the train thus saving money on labor and materials, and whose brake head which can be replaced in matter of minutes, saving time on all type of freight cars using a standard type brake beam, being particularly beneficial on intermodal or premium service trains and avoiding penalties and costs related with previous brake beams.

It is still a main object of the present invention to provide a brake beam thanks to which, it is possible, when installed in the car, to replace the brake head which is found at a damaged condemnable condition under a car in service, by a simple torch cut off process of the pin holding the damaged brake head of the beam under the car, pulling then the damaged component from the car bottom, which activity is simple and familiar to must skilled in the car repair art, and be then able to install the spare brake head of the present invention, as an spare brake beam, right there and then, without the dismantling of the train, car nor truck, with simple common tools and skills.

It is still another main object of the present invention to provide a brake beam thanks to which there are avoided the accidents and personal injuries to the maintenance staff related to car dismantling operations.

It is an additional object of the present invention to provide a brake beam having a replaceable brake head in which thanks to the DTI included in each brake head coupling section, when it is necessary to replace the brake head, the bolt that joins the brake head to the brake beam can be adjusted at the correct tension without the need of checking it with a feeler gauge or to loosing and tightening the bolt repeatedly until the correct tension is achieved.

These and other objects and advantages of the spare brake beam having a replaceable brake head of the present invention will become apparent to those persons having an ordinary skill in the art, from the following detailed description of the embodiments of the invention which will be made with reference to the accompanying drawings.

DETAILED DESCRIPTION OF THE INVENTION

Figure 1:
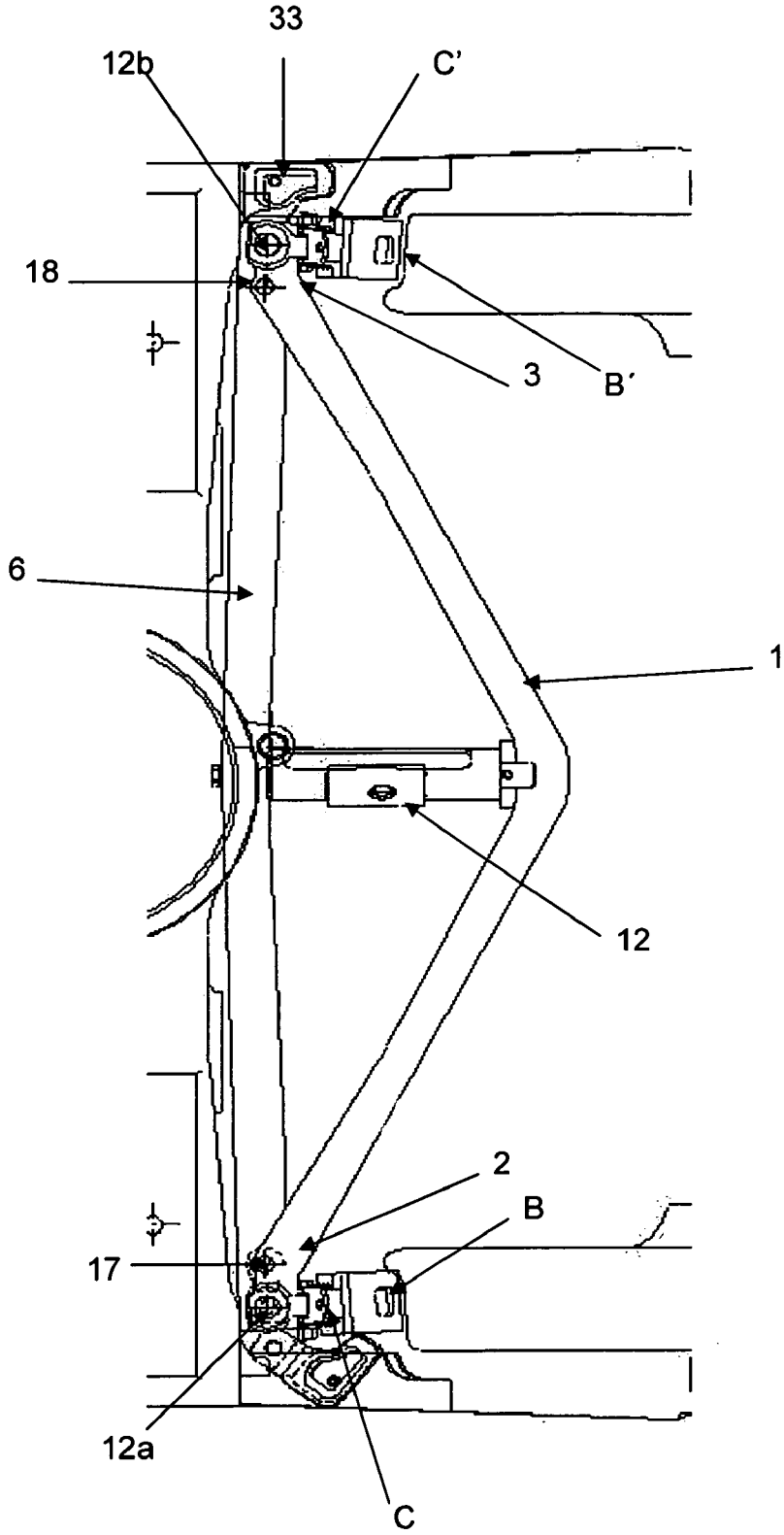
FIG. 1 is an upper view of a boogie of a railway car having the brake beam of the present invention showing the removable end extension detached from the interlocking member.
Figure 2:
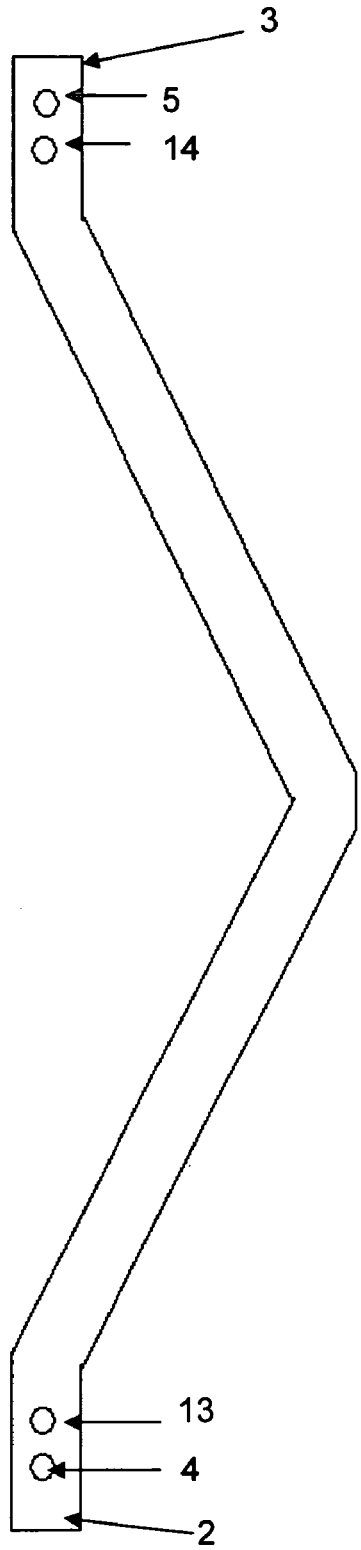
FIG. 2 is an upper view of the tension member of the brake beam of the present invention.
Figure 3:
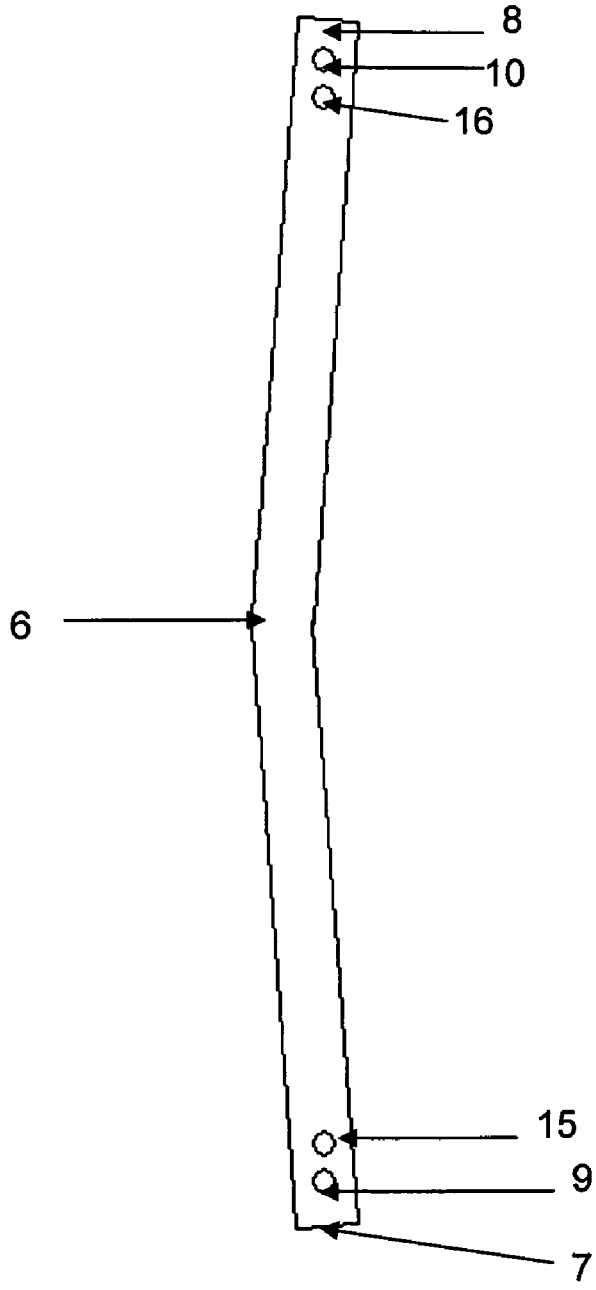
FIG. 3 is an upper view of the compression member of the brake beam of the present invention.
Figure 4:
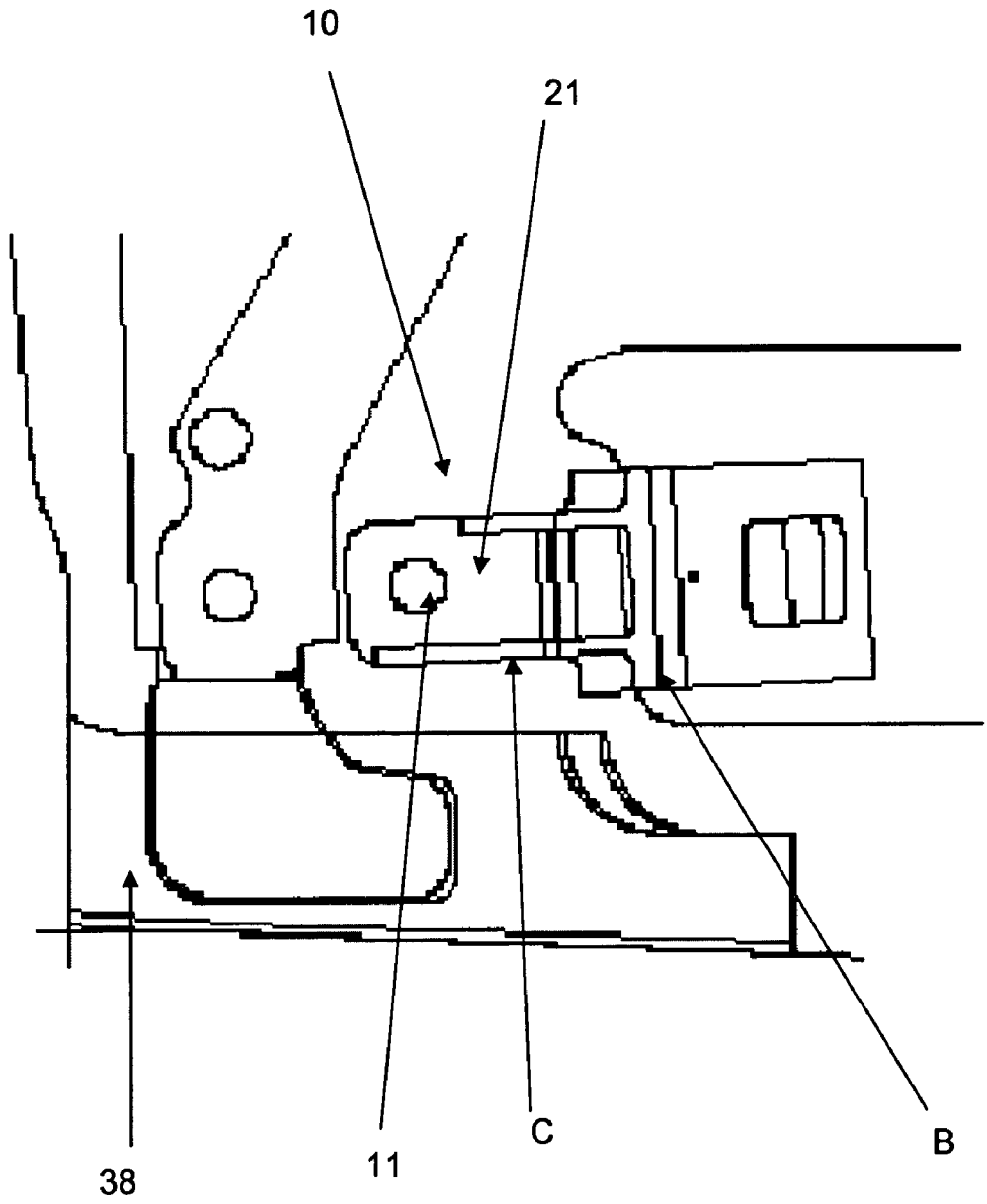
FIG. 4 is an upper view of a section of a boogie of a railway car having the brake beam of the present invention having a replaceable brake head detached thereof.
Figure 5:
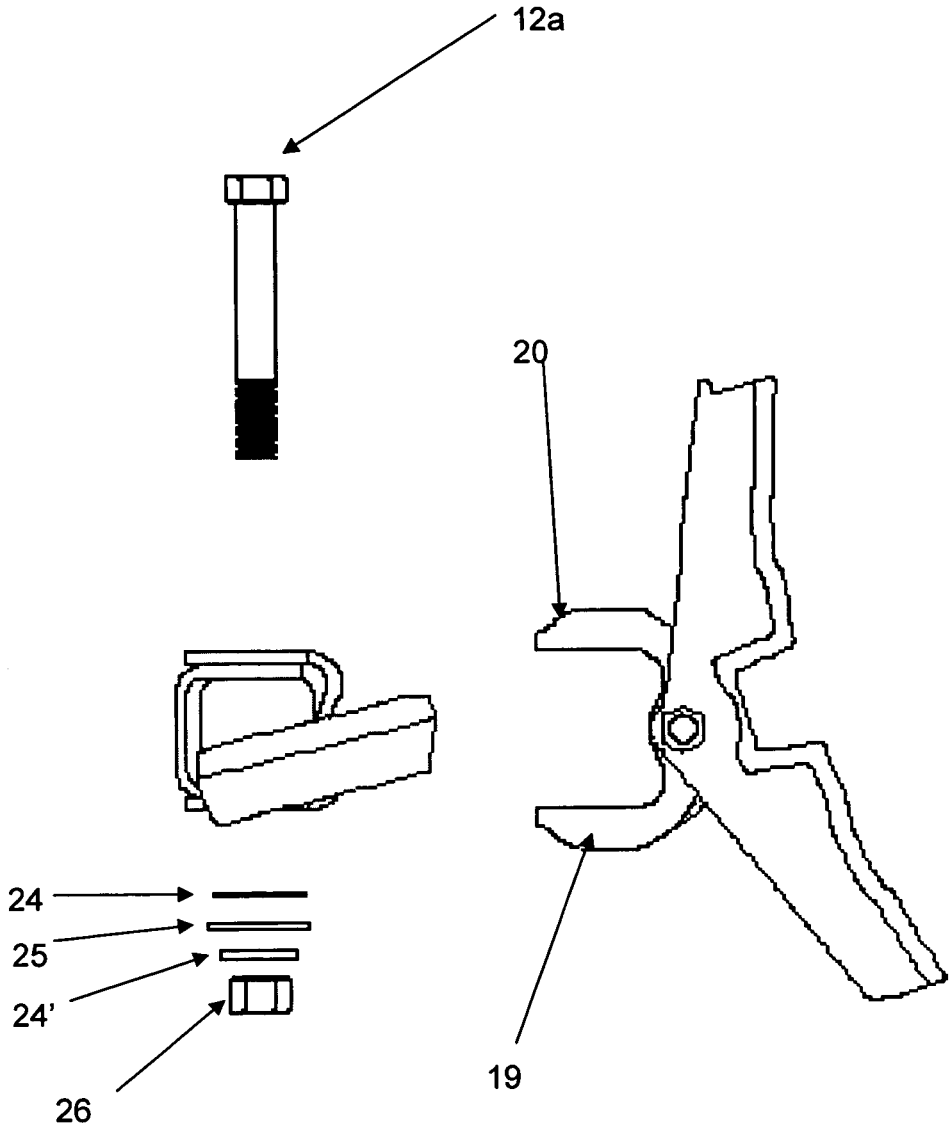
FIG. 5 is an exploded side view of the brake beam of the present invention including a replaceable brake head and its joining components.
Figure 6:
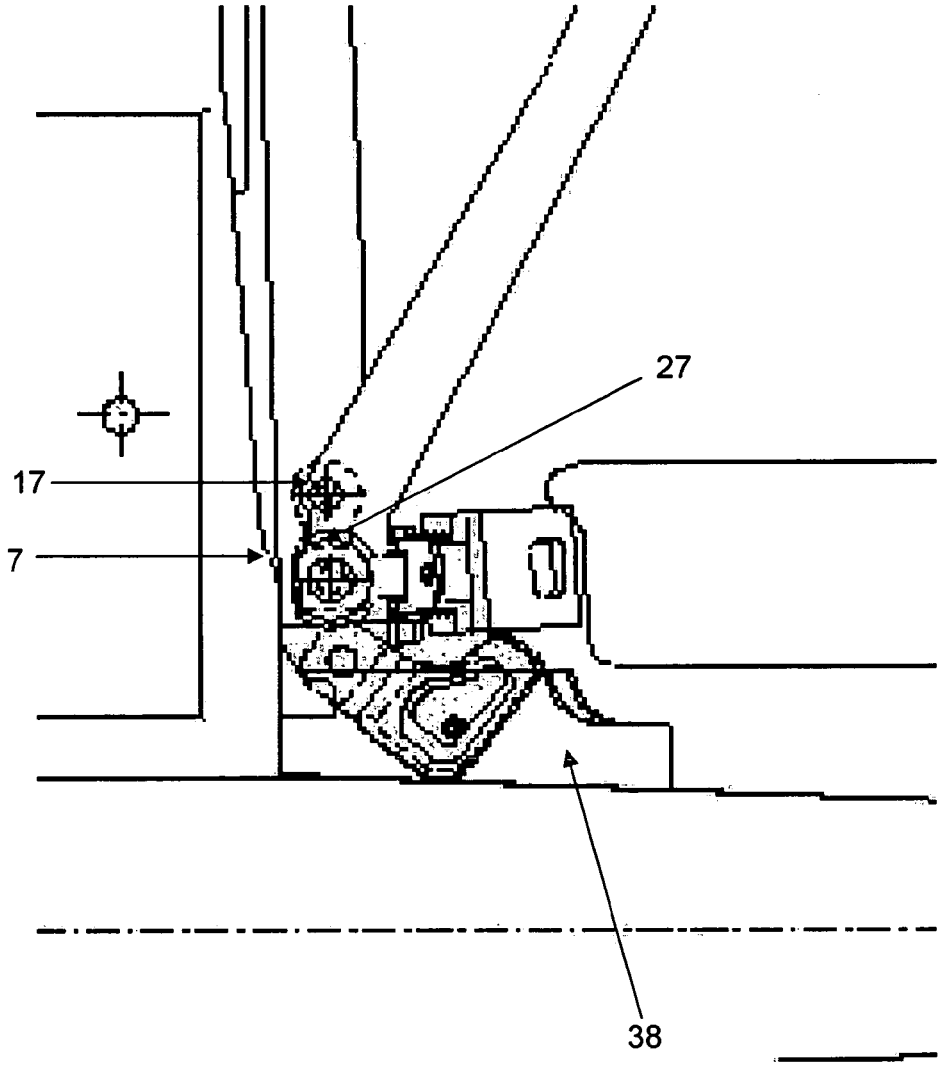
FIG. 6 is an upper view of a section of a boogie of a railway car having the brake beam of the present invention having the removable end extension detached from the interlocking member.
Figure 7:
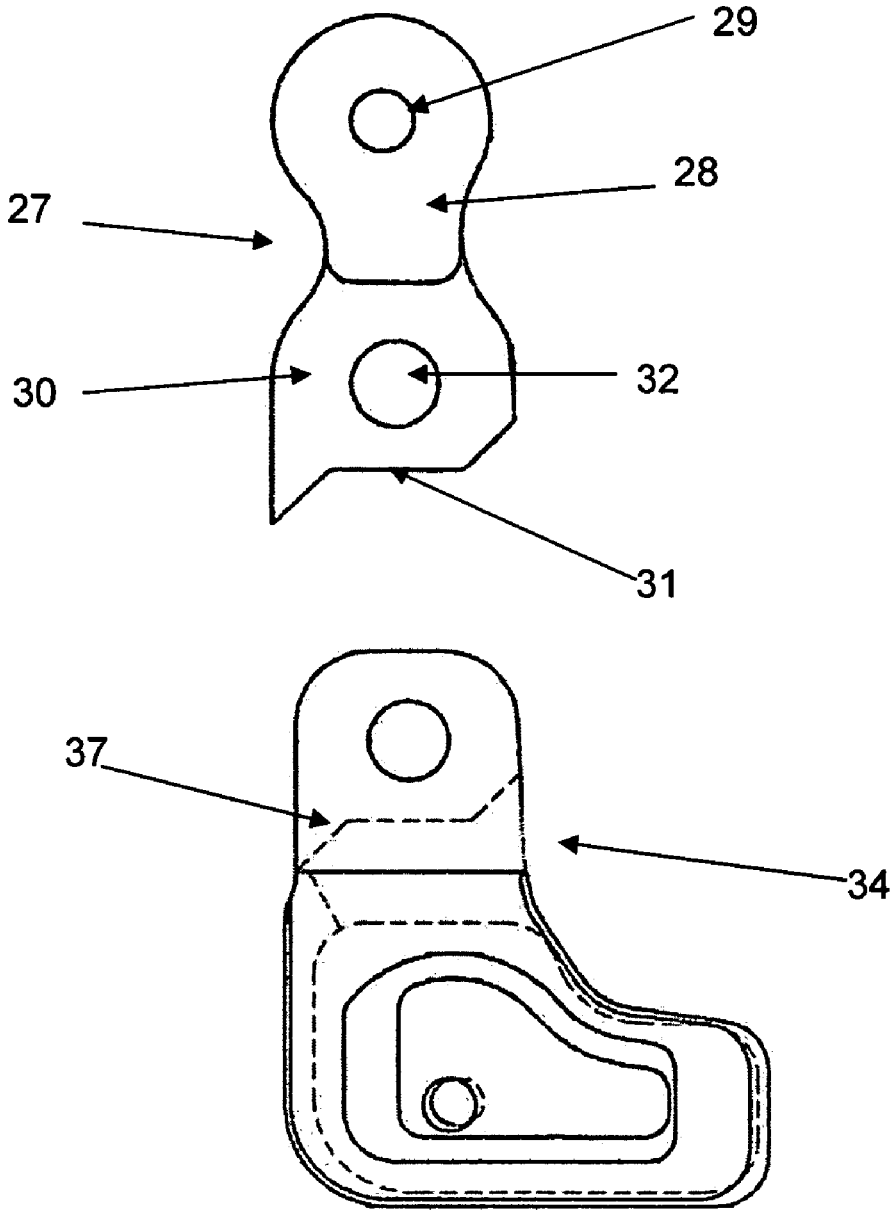
FIG. 7 is an upper view of the interlocking member and removable end extension of the brake beam of the present invention.
Figure 8:
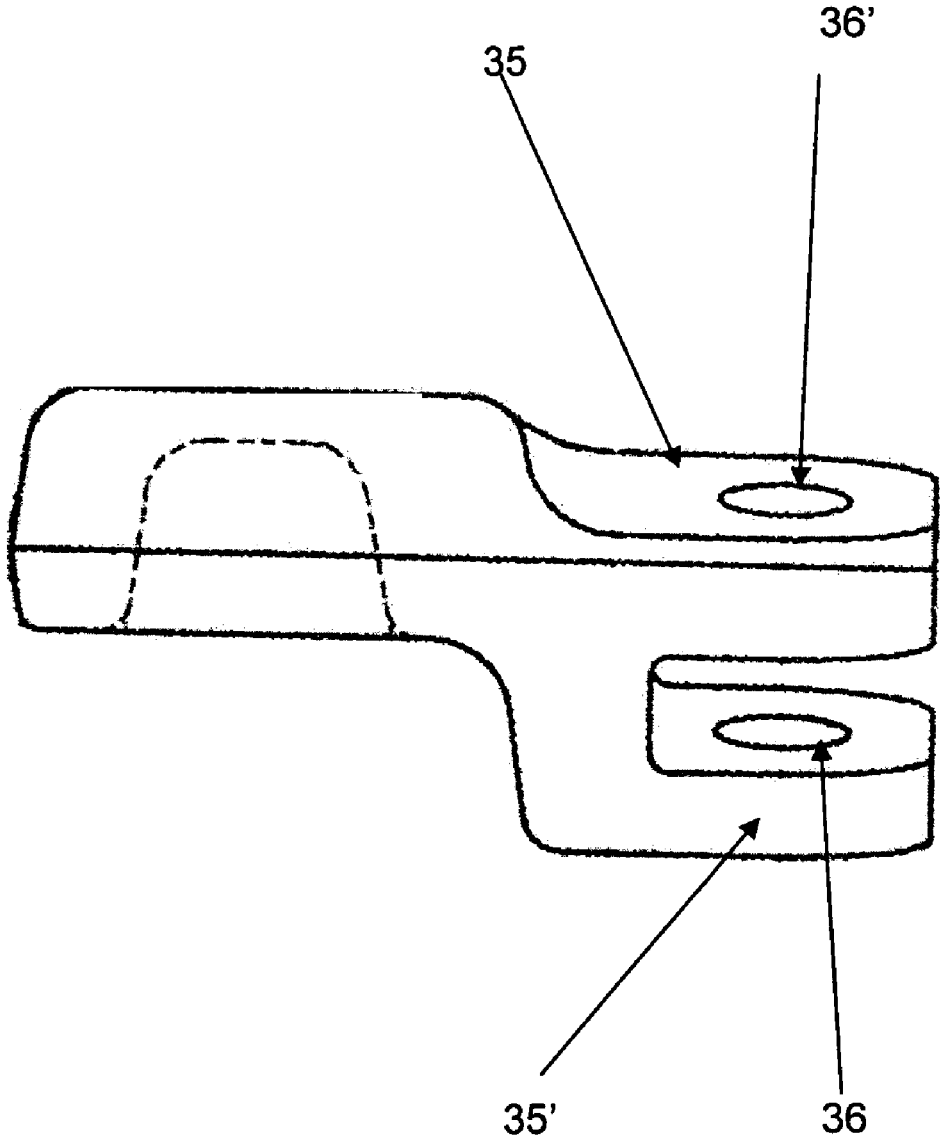
FIG. 8 is a perspective view of the removable end extension of the brake beam of the present invention.

The brake beam of the present invention will now be described making reference to a common brake beam, in accordance with its most general embodiment thereof illustrated in the accompanying drawings wherein the same signs and numbers, refer to the same parts of the shown figures, comprising:

a "V" shaped tension member 1 having a first end 2 and a second end 3, said "V" shaped tension member 1 having a channel shaped cross section (not shown) including a lower wall and two upwardly projecting side walls, each depending from an edge of the lower wall, and including a first 4 and a second pair 5 of opposite holes each hole located in opposite side walls opposite to each other and each pair located near the ends 4, 5 of the tension member 1;

a compression member 6, having a first end 7 and a second end 8 coinciding with the first 2 and second end 3 of the tension member 1, a channel shaped cross section (not shown) including an upper wall and two depending side walls, each depending from an edge of the upper wall, a channel shaped housing (not shown), and including a first 9 and a second pair 10 of opposite holes, each hole located in opposite side walls opposite to each other and each pair located in a side wall near the ends 7, 8 of the compression member 6 coinciding with the first 4 and second pair 5 of holes of the tension member 1, wherein the channel shaped cross section of the each end of the compression member 6 is located and joined inside the channel shaped cross section of the tension member 1;

two brake head subassemblies, each having a brake shoe B, B' and respectively linked to each end of the tension 1 and compression 6 members, each having a coupling section C, C' having bores 11 in a central portion thereof coinciding with the first and second pair of holes 4, 5 of the tension 1 and compression member 6 respectively; and a fulcrum 12 joined to the tension member 1 and compression member 6, so that the fulcrum 12 remains between the tension 1 and compression 6 members.

wherein the brake beam of the present invention is characterized by:

the tension member 1 and compression member 6, being releasable linked together by means of a first 12*a* and a second 12*b* releasable bolt each passing respectively through the first and second pair of opposite holes 4, 5 of the tension 1 and compression 6 member, and through the brake head bores 11, 11.

the "V" shaped tension member 1 including a further first 13 and a further second 14 pair of opposite holes, each hole located in opposite side walls opposite to each other and each further first 13 and second 14 pair respectively located near the ends 2, 3 of the tension member 1 and next to the first 4 and second 5 pair of opposite holes of the "V" shaped tension member 1 respectively, and in opposite side walls;

the compression member 6 including a further first 15 and second pair 16 of opposite holes, each hole located in opposite side walls opposite to each other and each pair respectively located near the ends 7, 8 of the compression member, next to the first 15 and second 16 pair of opposite holes of the compression member 6, and coinciding with the further first 13 and second 14 pair of opposite holes of the tension member 1 respectively;

the tension member 1 and compression member 6, being permanently linked together by means of a first 17 and a second 18 bolt each passing respectively through the further first 13, 15 and further second 14, 16 pair of opposite holes of the tension 1 and compression 6 member, thus avoiding the dismantling of the brake beam.

each brake head subassembly further comprising:

a brake shoe member B, B';

a coupling section C, C' for coupling the brake head to a brake beam comprising a pair of bracket ends 19, 20 joined to the brake shoe member 9, 9', each including a central planar screw-nut receiving section 21 having a hole 11, 11' coinciding with the first and second pair of opposite holes of the tension and compression member 13, 15, 14, 16, for receiving the screw 12*a*, 12*b*, so that the cross-section of the brake beam remains between both bracket ends 19, 20;

wherein the central planar screw-nut receiving section 21, 21' of one bracket end receiving a first washer 24, a DTI 25, a second washer 24' and a lock nut 26 in that order;

the spare brake beam having a replaceable brake head further including:

an interlocking member 27 located at the first end 7 of the compression member 6 inside its channel shaped cross section which in turn is located inside the channel shaped cross section of the tension member 1, comprising a solid planar metal piece having:

a brake beam coupling section 28 having a bore 29 at a central portion thereof coinciding with the further first pair of holes of the tension and compression member 13, 14, 15, 16, and coupled to the first end 2, 7 of the tension 1 and compression 6 members by means of the bolt 17 passing through the further first pair bores 13, 15, of the tension 1 and compression member 6, through the perforation 11 located at the central planar screw-nut receiving section 21, 21' of each brake head subassembly and through the bore 29 located at a central portion of the interlocking member 27 brake beam coupling section 28; and an end extension coupling section 30, opposite to the brake beam coupling section 28 including a coupling edge 31 having an irregular shape and having a bore 32 in a central portion thereof coinciding with the first further pair of opposite holes 4, 5, of the tension 1 and compression 6 member and with the bore 11 of the coupling section of the brake head subassembly and having a lesser width than the brake beam coupling section 28;

a fixed end extension 33 coupled to the second end 3 of the tension member 1;

a removable end extension comprising a solid metal piece having an interlocking member coupling member 34 comprising a clasp formed by two quadrangular planar metallic pieces 35, 35', each including a bore 36, 36' in a central portion thereof, an interlocking member coupling edge receiving section 37 located between both quadrangular planar metallic pieces 35, 35' having the same but opposed shape as the interlocking member coupling edge 31 and a pocket guide coupling member 38 opposed to the interlocking member coupling member;

wherein the removable end extension coupling section 30 of the interlocking member 27 is coupled to the tension 1 and compression 6 members and brake head subassembly, and is received between both quadrangular planar metallic pieces 35, 35' of the removable end extension, in such way that its coupling edge 31 engages with the interlocking member coupling edge receiving section 37 and is retained therein by means of the releasable bolt 12*a* passing through the first pair of coinciding bores 4 of the tension member 1, compression member 6 and through the hole 11 located at the central planar screw-nut receiving section 21 of the brake head subassembly which also passes through the bore 32 located at a central portion of the end extension coupling section 30 of the interlocking member and through the bores 36, 36', located at a central portion of both quadrangular planar metallic pieces 35, 35', forming the clasp which comprise the interlocking member coupling member 34 of the removable end extension, thus joining the tension member 1, compression member 6, brake head subassembly, interlocking member 27 and removable end extension together.

Since the coupling edge 31 of the interlocking member 27 engages with the interlocking member coupling edge receiving section 37 of the removable end extension, it is avoided any lateral movement of the removable end extension with respect to the brake beam when the brakes are applied.

When it's necessary to replace a common brake beam from a train car, the condemnable beam must be torched off from the car, decoupled from its linking levers, and removed from the boogie. Then, the removable end extension of the brake beam of the present invention is decoupled from the interlocking member 27, and the pocket guide coupling member 38 is inserted in the boogie pocket guide 39. The corresponding side brake head subassembly is then loose, and may be slid off the beam, to reduce its weight. Next, the brake beam of the present invention is slid under the boogie sitting on the rail and the end that has the fixed end extension 33 must be lifted, and its end extension inserted on the opposite side pocket guide of the truck. The first end with the decoupled end extension is then lifted to embrace with its hollow portion the mating link of the decoupled end extension, thus embracing it. This will hold the weight of the beam in place. Next, the brake beam of the present invention is pushed toward the wheel while at the same time the uncoupled end extension must be slid along its correspondent pocket guide, and at the same time the end extension must be slightly rotated over a vertical axis until its interlocking member coupling member 34 is completely inside the brake beam's channel shaped cross section. Then the corresponding loose brake head is slid back on the brake beam of the present invention, and all holes aligned, in order for the same provided bolt 12*a* to be inserted from the top, thus putting together the brake head subassembly, the brake beam structure and the decoupled end extension, thorough one single operation.

Thanks to the first 17 and second 18 bolt passing through the further first 15 and second 16 pair of opposite holes of the tension and compression member, it is avoided that the brake beam become disassembled when the bolt 17 is retired for decoupling the removable end extension.

Although it was described that the brake beam of the present invention has one removable end extension and one fixed end extension, both end extensions may be removable.

In other embodiments of the invention, the interlocking member 27 may be omitted and instead it could be provided any means for avoiding the lateral movement of the end extensions—interlocking means—formed inside the cross section of the tension member or compression member such as a pair of bump elements (not shown) formed inside the cross section of the compression or tension members in such way that it prevents the edges of each planar metallic piece 35, 35' to laterally move.

Although in the above described preferred embodiment, the spare brake beam has a common design (tension member, compression member, etc.), it may have other design, for example a one piece brake beam in which the tension and compression member are welded together, as well as the brake head subassemblies, or brake beams lacking the tension member.

If it is required to install a replaceable brake head, to the brake beam of the present invention, the following steps must be carried out:

Slide the replaceable brake head in the truss.

Align the hole located at the central planar screw-nut receiving section 21, 21' with the first 4 or second 5 pair of opposite holes of the brake beam and slide the bolt 12*a* or 12*b* from top.

Insert the first washer 24, the DTI 25, the second washer 24 and the lock nut 26 in that order.

Apply torque to the nut 26 with a wrench until the DTI 25 substance indicator pops out (or use a torque wrench if so desired).

Also, thanks to the first and second bolt passing through the further first 4 and second 5 pair of opposite holes of the first ends 2, 7 of the tension 1 and compression 6 member, it is avoided that the brake beam of the present invention become disassembled when the bolts 12*a* or 12*b* passing through the first 4 and second 5 pair of opposite holes is/are retired for decoupling the brake heads.

Figure 9:
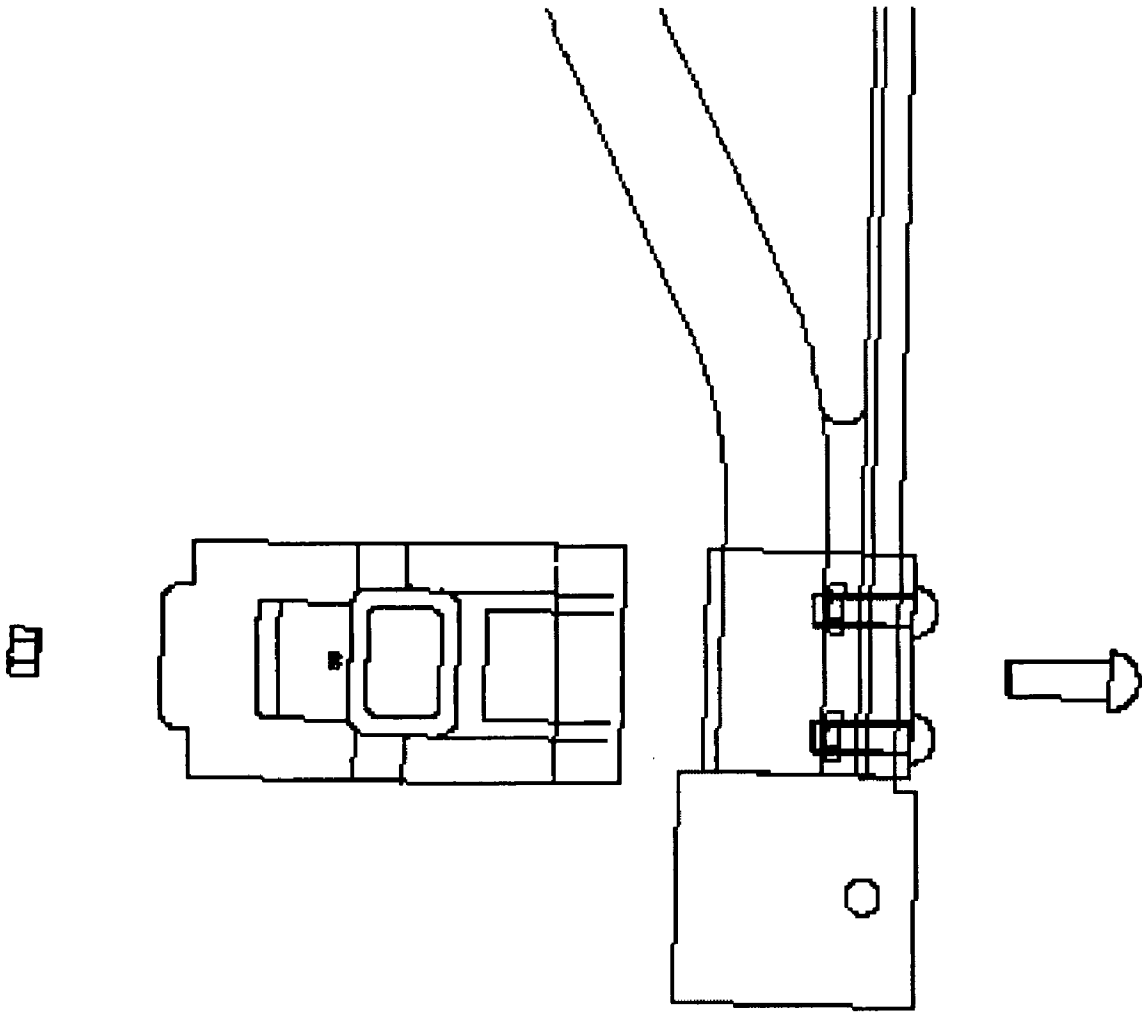
FIG. 9 illustrates a superior portion of the brake head coupling section.

Although it was described, that the brake head coupling section has a pair of bracket ends 19, 20, it is possible that in other embodiments of the present invention, the brake head coupling section be comprised of any other suitable elements. It may be possible that the brake head coupling section has a shape designed to be received and retained inside the cross section of the tension 1 and compression 6 member by means of a bolt passing through respective holes located at the upper and lower walls of the tension and compression member respectively through a hole located in a superior portion of the brake head coupling section as shown in FIG. 9.

Furthermore, the DTI's 25 received in the central planar screw-nut receiving section 21, 21' of both brake heads described in the preferred embodiment, which allow to adjust the bolt 12*a* that joins the brake head to the brake beam at a correct tension without the need for a Torque Wrench when a new brake head is being installed, may be omitted. Therefore if no DTI's are used, the torque at which the bolts 12*a* and/or 12*b* that joins the brake head to the brake beam must be adjusted, will have to be checked with torque wrench when a new brake head is been installed.

The further first 17 and second 18 pair of bolts which avoid the brake beam to become disassembled when the bolts 12*a* and/or 12*b* is/are retired for decoupling a removable end extension or a brake head, may be substituted by any means capable of avoiding the brake beam to become disassembled when the bolts 12*a* and/or 12*b* is/are retired.

From the above referred description, It would be obvious to any person skilled in the art that since the brake beam of the present invention includes means for allowing the dismantling thereof, it can be configured to:

Be replaceable and to include permanently fixed brake heads.

Include replaceable brake heads and to not include any means for allowing the brake head to be replaceable, or.

Be replaceable and to include replaceable brake heads.

Finally it must be understood that the brake beam of the present invention, is not limited exclusively to the embodiments above described and illustrated and that the persons having ordinary skill in the art can, with the teaching provided by the invention, to make modifications to the design and component distribution of the brake beam of the present invention, which will clearly be within of the true inventive concept and of the scope of the invention which is claimed in the following claims:

The invention claimed is:

1. A brake beam for railway cars in which the brake heads can be replaced without dismantling the brake beam nor the car or truck and which can be installed and retired from the truck without dismantling the car comprising:

a tension member;

a compression member a first replaceable and detachable brake head and a second replaceable and detachable brake head;

at least one removable end extension; and joining parts joining only the compression member to the tension member in a manner avoiding the disassembling of the brake beam when the brake heads are retired from the brake beam, wherein, the tension member and the compression member have a first end and a second end which coincide, the first and second replaceable and detachable brake heads each include:

a brake shoe member and a coupling section for coupling the brake head to a brake beam, said coupling section being releasable linked to an end of the tension and compression members, at least one end of the tension and compression members further including an interlocking member, the joining parts comprising a pair of bolts passing through holes located near each end of the tension and compression members and through a first perforation located at the interlocking member thus permanently joining the tension and compression members and the interlocking member together;

the brake beam having at least one detachable end extension having an interlocking member coupling member being detachably joined to the interlocking member, to an end of the tension and compression members, and to a first one of the first detachable brake heads.

2. A brake beam as claimed in claim 1, wherein, the coupling sections of each replaceable and detachable brake head comprise a pair of bracket ends joined to the brake shoe member, each including a central planar screw-nut receiving section for receiving a removable bolt, so that the cross-section of the brake beam remains between both bracket ends and the central planar screw-nut receiving section of one bracket end receiving a first washer, a DTI washer, a second washer and a lock nut in that order;

the interlocking member comprising a solid planar metal piece having:

a brake beam coupling section having the first perforation at a central portion thereof and coupled to an end of the tension and compression members by one of the bolts comprising the joining parts passing through the first perforation; and an end extension coupling section, opposite to the brake beam coupling section including a coupling edge having an irregular shape and having a bore for receiving a removable bolt and having a lesser width than the brake beam coupling section; and the at least one removable end extension comprising a solid metal piece having i) an interlocking member coupling member comprising a clasp formed by two quadrangular planar metallic pieces, each including a bore in a central portion thereof, and ii) an interlocking member coupling edge receiving section located between both quadrangular planar metallic pieces having the same but opposed shape as the interlocking member coupling edge and a pocket guide coupling member opposed to the interlocking member coupling member;

wherein the end extension coupling section of the interlocking member is coupled to the tension and compression members and brake head, and is received between both quadrangular planar metallic pieces of the removable end extension, in such way that its coupling edge engages with the interlocking member coupling edge receiving section and is retained therein a releasable bolt passing through the tension member, compression member and through the holes located at each bracket end central planar screw-nut receiving section of the first brake head which also passes through the bore located at a central portion of the end extension coupling section of the interlocking member and through the bores located at a central portion of both quadrangular planar metallic pieces, forming the clasp which comprise the interlocking member coupling member of the removable end extension, thus joining the tension member, compression member, brake head subassembly, interlocking member and removable end extension together.

3. A brake beam in which the brake heads can be replaced without dismantling the brake beam, the brake beam comprising:

a V-shaped tension member (1) having a first end (2) with a first hole (4) and a second end (3) with a second hole (5);

a compression member (6), having a first end (7) with a first hole (9) and a second end (8) with a second hole (10), the first end (7) and the second end (8) of said compression member coinciding with the first end (2) and the second end (3) of the tension member (1), the first hole (9) and the second hole (10) of said compression member coinciding with the first hole (4) and the second hole (5) of the tension member (1), wherein the each end of the compression member is located and joined inside a corresponding each of the tension member;

two brake head subassemblies, each brake head subassembly having a brake shoe (B, B') respectively linked to each end of the tension member and the compression member, each brake head subassembly having a coupling section (C, C') having bores (11) in a central portion thereof coinciding with the first holes and second holes of the tension member and of the compression member respectively, wherein, the tension member and the compression member are releasable linked together by a first releasable bolt (12*a*) and a second releasable bolt (12*b*), the first and second releasable bolts passing respectively through the first holes and second pair of holes of the tension member and the compression member and through the brake head bores;

within the tension member, a further first hole (13) and a further second hole (14) located respectively in the first and second ends of the tension member adjacent the first holes (4) and the second hole (5) of the tension member;

within the compression member, a further first hole (15) and a further second hole (16) located respectively in the first and second ends of the compression member and coinciding with the further first hole (13) and further second hole (14) of the tension member respectively;

a first bolt (17) and a second bolt (18) permanently linking together the tension member (1) and the compression member (6) by the first bolt (17) and the second bolt (18) each passing respectively through the further first holes (13, 15) and the further second holes (14, 16) of the tension member and the compression member, thus avoiding the dismantling of the brake beam, wherein each brake head subassembly further comprises a brake shoe member (9, 9'), the coupling section (10, 10') coupling the brake head to a brake beam, the coupling section comprising a pair of bracket ends (19, 20) joined to the brake shoe member (9, 9'), each bracket end including a central planar screw-nut receiving section (21) having one of the bores (11, 11') coinciding with the further first and further second holes (13, 15, 14, 16) of the tension member and the compression member, receiving the releasable bolts (12*a*, 12*b*) with the cross-section of the brake beam remaining between both bracket ends (19, 20), wherein the central planar screw-nut receiving section (21, 21') of one bracket end receives a first washer (24), a DTI washer (25), a second washer (24') and a lock nut (26) in that order;

an interlocking member (27) located at the first end (7) of the compression member and having a brake beam coupling section (28) with a bore (29) coinciding with the further first holes and the further second holes (13, 14, 15, 16) of the tension member and the compression member, and coupled to the first end of the tension member and the compression member by the first bolt (17) passing through the further first holes (13, 15) of the tension member and the compression member, through the bores (11) of each brake head subassembly and through the bore (29) of the interlocking member (27); and an end extension coupling section (30), opposite to the brake beam coupling section (28), the end extension coupling section (30) including a coupling edge (31) having a bore (32) coinciding with the first further holes (13, 15) of the tension member and the compression member.

4. The brake beam of claim 3, further comprising:

a fulcrum (12) joined to the tension member and to the compression member so that the fulcrum remains between the tension member and the compression member.

5. A brake beam in which the brake heads can be replaced without dismantling the brake beam, the car, or the truck and which can be installed and retired from the truck without dismantling the car, the brake beam comprising:

a first replaceable and detachable brake head;

a second replaceable and detachable brake head;

at least one removable end extension;

a tension member having a first end and a second end;

a compression member having a first end and a second end, the first and second ends of the compression member placed inside the first and second ends of the tension member;

the first and second replaceable and detachable brake heads each including i) a brake shoe member and ii) a coupling section for coupling the brake head to a brake beam having a perforation, the second replaceable brake head being releasable linked to the second end of the tension member and the compression member by a releasable bolt passing through holes located at the second end of the tension member and the compression member and through the perforation located at the coupling section of the second replaceable brake head;

the first end of the tension and compression member further including an interlocking member having a first perforation and a second perforation and located at the first end of the tension member and the compression member inside the channel shaped cross section of the tension member;

a pair of bolts passing through holes located near each end of the tension member and the compression member and through the first perforation of the interlocking member thus permanently joining the tension member and the compression member and the interlocking member together;

one detachable end extension including an interlocking member coupling member having a perforation; and the interlocking member coupling member of the detachable end extension being joined to the interlocking member, first end of the tension and compression member, and the first detachable brake head by a removable bolt passing through the second perforation of the interlocking member, through the perforation of the interlocking member coupling member, through further perforations located at the first end of the tension and compression member and through the perforation of the coupling section of the first detachable brake head thus joining the first end of the tension and compression members, the detachable end extension, interlocking member and first releasable brake head together in a releasable way.

6. A brake beam as claimed in claim 5, wherein, the coupling sections of each replaceable and detachable brake head comprises a pair of bracket ends joined to the brake shoe member, each including a central planar screw-nut receiving section for receiving the removable bolt, so that the cross-section of the brake beam remains between both bracket ends;

the central planar screw-nut receiving section of one bracket end receives a first washer, a DTI washer, a second washer and a lock nut in that order;

the interlocking member comprises a solid planar metal piece having: a brake beam coupling section having the first perforation at a central portion thereof and coupled to the first end of the tension and compression members by means of one of the bolts comprising the means for avoiding the disassembling of the brake beam passing through the first perforation located at a central portion; and an end extension coupling section, opposite to the brake beam coupling section including a coupling edge having an irregular shape and having the second perforation for receiving the removable bolt and having a lesser width than the brake beam coupling section;

the removable end extension comprises a solid metal piece having an interlocking member coupling member comprising a clasp formed by two quadrangular planar metallic pieces, each including a bore in a central portion thereof, an interlocking member coupling edge receiving section located between both quadrangular planar metallic pieces having the same but opposed shape as the interlocking member coupling edge and a pocket guide coupling member opposed to the interlocking member coupling member; and the removable end extension coupling section of the interlocking member is coupled to the tension and compression members and brake head subassembly, and is received between both quadrangular planar metallic pieces of the removable end extension, in such way that its coupling edge engages with the interlocking member coupling edge receiving section and is retained therein by means of the releasable bolt passing through the tension member, compression member and through the holes located at each bracket end central planar screw-nut receiving section of the first brake head subassembly which also passes through the bore located at a central portion of the end extension coupling section of the interlocking member and through the bores located at a central portion of both quadrangular planar metallic pieces, forming the clasp which comprise the interlocking member coupling member of the removable end extension, thus joining the tension member, compression member, brake head subassembly, interlocking member and removable end extension together.

* * * * *